US011480402B2

(12) United States Patent
Brooksby et al.

(10) Patent No.: US 11,480,402 B2
(45) Date of Patent: Oct. 25, 2022

(54) LOCATION-BASED GUN MAGAZINE

(71) Applicant: Connor Brooksby, Washington, UT (US)

(72) Inventors: Connor Brooksby, Washington, UT (US); Wayne Provost, St. George, UT (US); Sheldon Shelley, St. George, UT (US); Michael Sanders, Pleasant Grove, UT (US)

(73) Assignee: Connor Brooksby, Washington, UT (US)

( * ) Notice: Subject to any disclaimer, the term of this patent is extended or adjusted under 35 U.S.C. 154(b) by 0 days.

(21) Appl. No.: 17/325,427

(22) Filed: May 20, 2021

(65) Prior Publication Data

US 2021/0381789 A1 Dec. 9, 2021

Related U.S. Application Data

(63) Continuation-in-part of application No. 16/712,573, filed on Dec. 12, 2019, now Pat. No. 11,015,889.

(60) Provisional application No. 62/778,694, filed on Dec. 12, 2018.

(51) Int. Cl.
*F41A 17/08* (2006.01)
*F41A 17/34* (2006.01)

(52) U.S. Cl.
CPC ..... *F41A 17/08* (2013.01); *F41A 17/34* (2013.01)

(58) Field of Classification Search
CPC ..... F41A 17/00; F41A 17/06; F41A 17/063; F41A 17/08; F41A 17/34
See application file for complete search history.

(56) References Cited

U.S. PATENT DOCUMENTS

| | | | | |
|---|---|---|---|---|
| 2,066,361 | A * | 1/1937 | Nomar | F41A 9/82 42/49.01 |
| 2,380,083 | A * | 7/1945 | Spagnolol | F41A 9/83 42/18 |
| 4,676,138 | A * | 6/1987 | Thompson | F41A 9/32 89/33.14 |
| 11,015,889 | B2 * | 5/2021 | Brooksby | G01S 19/14 |
| 2005/0115128 | A1 * | 6/2005 | Hahin | F41A 9/65 42/50 |
| 2014/0366419 | A1 * | 12/2014 | Allan | F41A 17/063 42/70.06 |

* cited by examiner

*Primary Examiner* — Bret Hayes
(74) *Attorney, Agent, or Firm* — Gurr Brande & Spendlove, PLLC; Robert A. Gurr

(57) ABSTRACT

A location-based gun magazine has a housing having a plurality of locking apertures, a spring, a wireless receiver switching device, a battery, and an electromagnet locking mechanism. The electromagnet locking mechanism has a locking tab for engaging and locking with the plurality of locking apertures, the locking tab actuatable via the electromagnet, the electromagnet receiving a signal from the wireless receiver switching device. The wireless receiver switching device may have a radio receiver, a GPS chip, or other device for receiving location-based information.

19 Claims, 19 Drawing Sheets

LOCATION-BASED GUN MAGAZINE

CROSS-REFERENCE TO RELATED APPLICATIONS

This application is a continuation-in-part of U.S. patent application Ser. No. 16/712,573, filed on Dec. 12, 2019, which claims the benefit of U.S. Provisional Application Ser. No. 62/778,694, filed on Dec. 12, 2018, which is incorporated herein by reference.

TECHNICAL FIELD

The present disclosure relates to firearms. More particularly, the present disclosure relates to a gun magazine that is controlled depending upon its physical location.

BACKGROUND

The U.S. Second Amendment is a vital part of the Constitution, and one that allows the bearing of arms. However, with the rise in domestic terrorism and mass-shootings, particularly at schools, there remains a need to protect the innocent. As a result, gun-control legislation is a constant topic among lawmakers. However, while many legislative positions have been suggested, those positions have failed to be become laws mainly due to the contrary effect it would have on the Second Amendment. As a result, there remains a need to protect the innocent while not infringing the rights of the people to bear arms under the Second Amendment.

Further, there remains a need of a gun owner to control where, when, and how their weapon is fired. For example, a gun owner that uses a gun for sport may desire that the gun not be capable of firing in the house. Currently, there are a number of methods employed by gun owners to prevent unwanted firing, such as trigger locks, gun safes, disassembling the weapon, etc. However, most of these methods are time-consuming, burdensome, and require affirmative action by the gun owner. If a user fails to take one of the above precautions, the firearm risks being fired by accident or in an unauthorized manner, such as by a third-party who gained access to the firearm. Therefore, there remains a need for a method of controlling/securing a firearm without requiring affirmative steps.

Likewise, a gun owner may desire a firearm for self-defense in the home, but may not want that gun to be used as part of a shooting outside of the home in a non-defense situation. Accordingly, there remains a need to control/secure a gun by an owner without having to undertake affirmative steps.

Accordingly, the present invention seeks to solve these and other problems.

SUMMARY OF EXAMPLE EMBODIMENTS

In one embodiment, a location-based gun magazine comprises a housing having a plurality of locking apertures, a spring, a wireless receiver switching device, a battery, and an electromagnet locking mechanism coupled to a follower. In one embodiment, the electromagnet locking mechanism comprises a locking tab for engaging and locking with the plurality of locking apertures, the locking tab actuatable via the electromagnet, the electromagnet receiving a signal from the wireless receiver switching device.

In one embodiment, the wireless receiver switching device comprises a radio receiver. In one embodiment, the wireless receiver switching device comprises a GPS chip.

In one embodiment, a location-based gun magazine comprises a housing having a spring, a wireless receiver switching device, a battery, a solenoid, a spool, and a cable coupled to the follower and windable on the spool.

DETAILED DESCRIPTION OF EXAMPLE EMBODIMENTS

Figure 1:
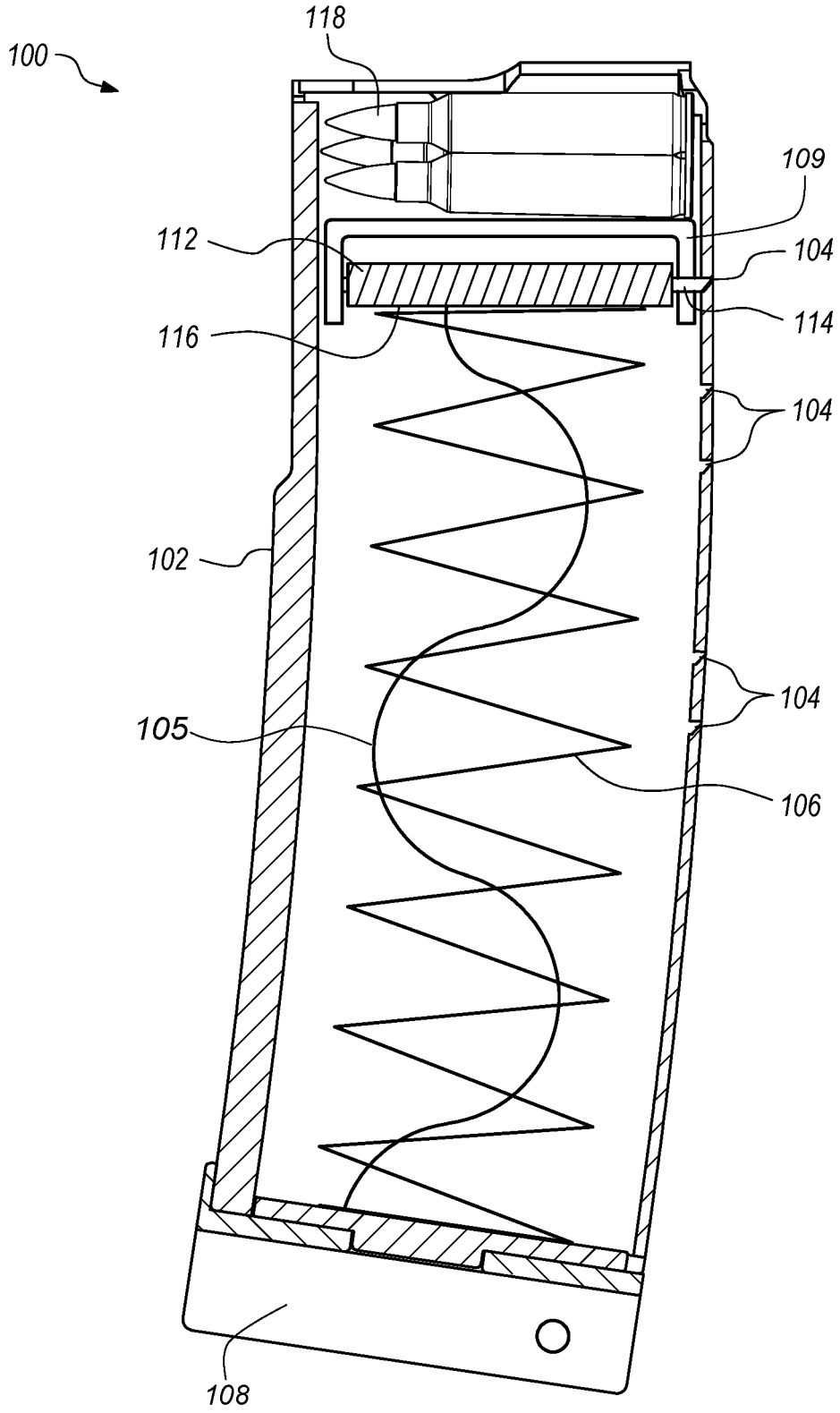
FIG. 1 illustrates a cross-section of a side elevation view of a location-based gun magazine.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may. Further, particular features, structures, or characteristics in one drawing of "one embodiment" may be combined with any other drawing in any other embodiment.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need to protect the innocent while not infringing the rights of the people to bear arms under the Second Amendment. Further, there is a need for a method of controlling/securing a firearm without requiring affirmative steps by a user. The location-based gun magazine described below solves these, and other, problems.

In one embodiment, as generally shown in FIG. 1, a location-based gun magazine 100 comprises a housing 102 having a plurality of locking apertures 104, a spring 106, a wireless receiver switching device 108, a battery 110 (FIG. 3), and an electromagnet locking mechanism 112 (also referred to as a "follower lock"). In one embodiment, the electromagnet locking mechanism 112 comprises a locking tab 114 for engaging and locking with the plurality of locking apertures 104, the locking tab 114 actuatable via the electromagnet 116, the electromagnet 116 receiving a signal from the wireless receiver switching device 108 via wire 105. In one embodiment, the wireless receiver switching device 108 comprises a radio receiver. In one embodiment, the wireless receiver switching device comprises a GPS (Global Positioning System) receiver. Therefore, in one embodiment, the wireless receiver switching device 108 sends a signal to the electromagnet 116 based upon a signal received (radio) or based upon its location (GPS). In one non-limiting example, the wireless receiver device uses GPS to determine its location. If the location is determined to be a shooting zone (e.g., shooting range), the wireless receiver switching device 108 sends a signal, activating the electromagnet 116. When activated, the electromagnet 116 (e.g., solenoid) withdraws the locking tab 114 (i.e., linear actuator) from the locking apertures 104. This allows the spring 106 to extend as bullets 118 are expended, allowing successive bullets 118 to be used (i.e., functions as a standard gun magazine). In the alternative, if the GPS receiver of the wireless receiver switching device 108 is not in a safe zone (e.g., a school), the solenoid (electromagnet 116) remains inactive and the locking tab 114 remains extended through a locking aperture 104, preventing the advancement of the follower 109, which prevents bullets 118 from entering the gun for use.

Figure 2:
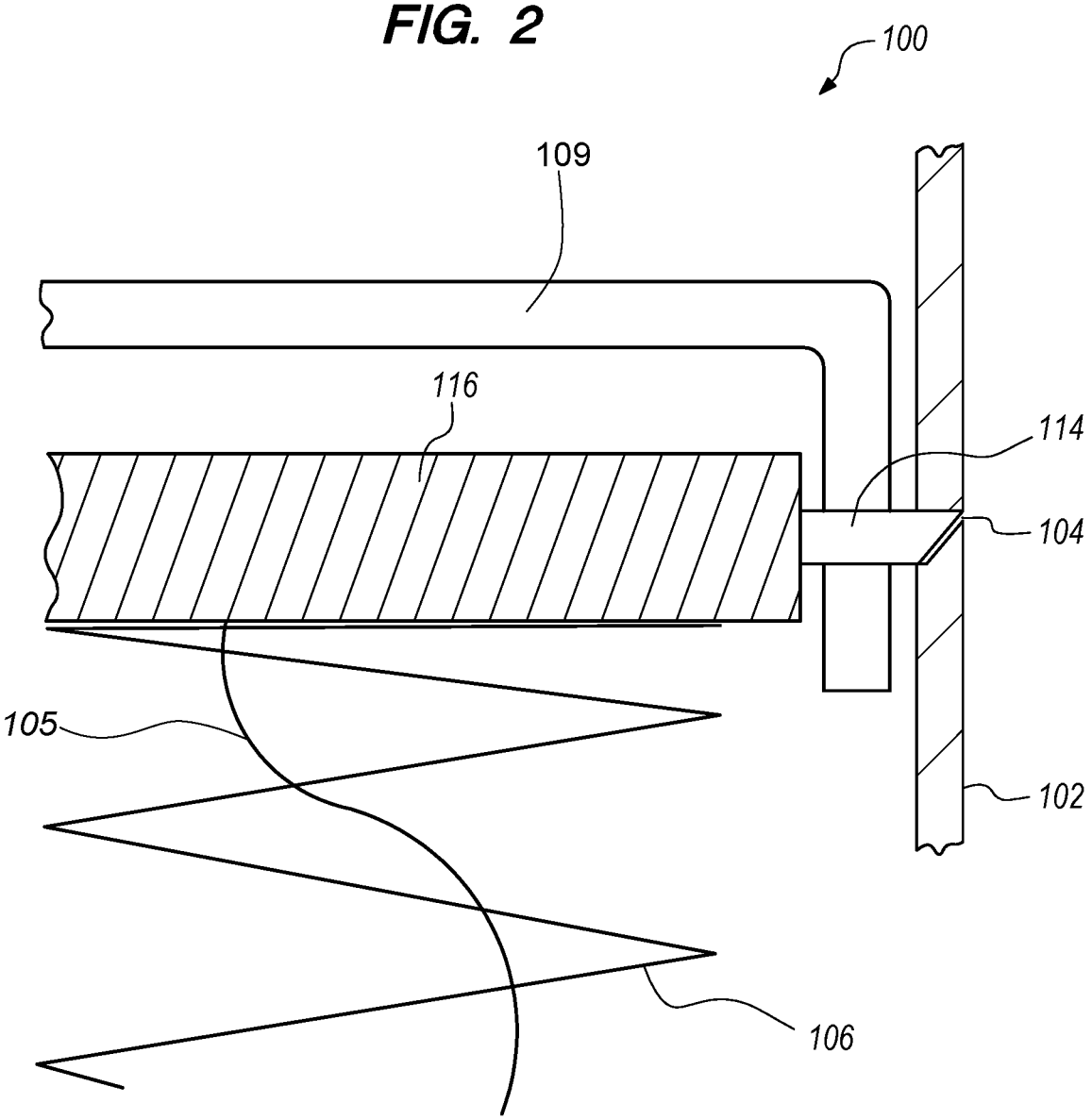
FIG. 2 illustrates a detailed cross-section of a location-based gun magazine.

As shown in FIG. 2, the locking tab 114 may be shaped (e.g., angled) so as to allow movement in a first direction (i.e., downward for loading the magazine 100) while prohibiting movement in a second direction (i.e., prohibiting movement upward, keeping the follower 109 from advancing). In this manner, when the locking tab 104 is engaged, bullets 118 may not exit the magazine 100. In one embodiment, shooting zones (e.g., shooting ranges) may be programmed by the manufacturer or may be input by the owner. For example, an owner of a gun may program the magazine 100 so that the magazine 100 only functions at certain shooting ranges. In this way, the owner's gun may not be used, stolen, or otherwise used in an unauthorized manner for a mass-shooting. In other words, the magazine 100 will only function at a gun range, or other area as defined by the owner (or manufacturer).

Other scenarios are envisioned. For example, a homeowner may desire a gun for self-defense, but would not allow that gun to be fired at a school. The owner could program the magazine 100 to be usable at home (i.e., the locking tab 114 would be withdrawn from the locking apertures 104) while not being usable outside of the owner's property (i.e., locking tab 114 engaged with the locking aperture 104). Again, this prevents unauthorized use of the weapon for domestic terrorism, mass shootings, or other violence.

The wireless receiving switching device 108 may be programmable using a computer or smartphone interface using USB cables or wireless connections (e.g., Bluetooth®). Once connected to the wireless receiving switching device 108, a user may customize its use via a user input display (e.g., phone or computer) by programming a microcontroller or similar device on the wireless receiver switching device 108.

Figure 3:
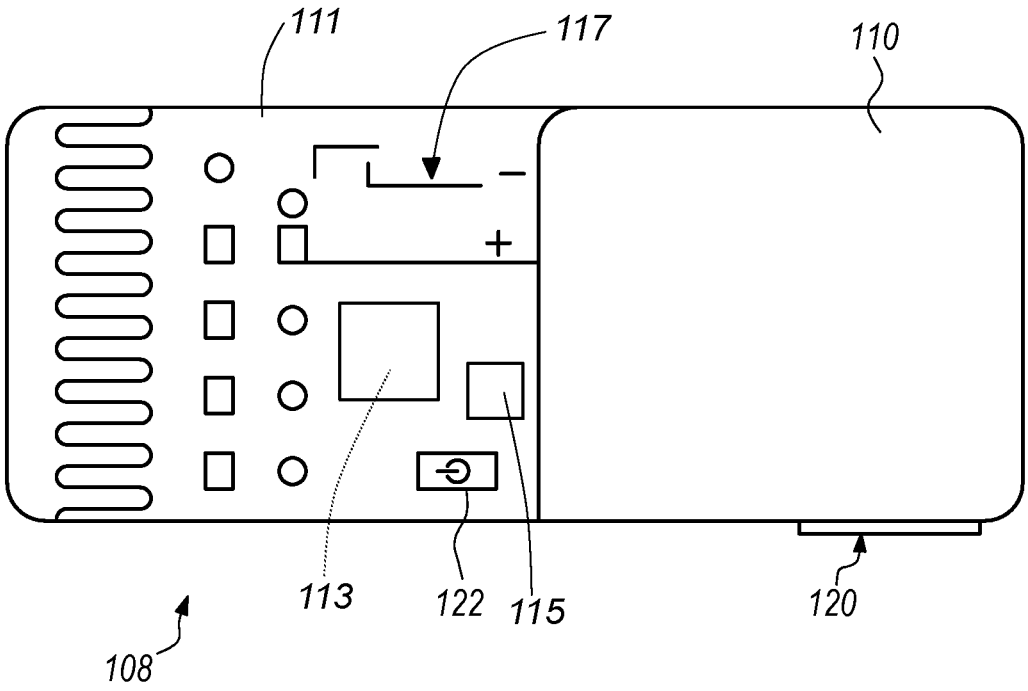
FIG. 3 is a diagram of a wireless receiving switching device of a location-based gun magazine.

FIG. 3 illustrates the wireless receiver switching device 108 in greater detail. As shown, the wireless receiver switching device 108 comprises a circuit board 111, microcontroller 113, GPS receiver 115, switch 117, and battery 110. The battery 110 may be rechargeable, such as using a charging port 120. In one embodiment, if the battery 110 is overly drained or disconnected, the locking tab 114 remains extended and engaged with a locking aperture 104. This result is achieved by the electromagnet 116 being de-energized with the locking tab 114 remaining extended (such as by using a spring, as is common in solenoid linear actuator systems). This prevents a user from merely disconnecting the battery 110 in an attempt to utilize the magazine 100 in an unauthorized manner. The wireless receiver switching device 108 may also comprise an on/off switch 122, allowing the life of the battery 110 to be extended when not in use.

Figure 4:
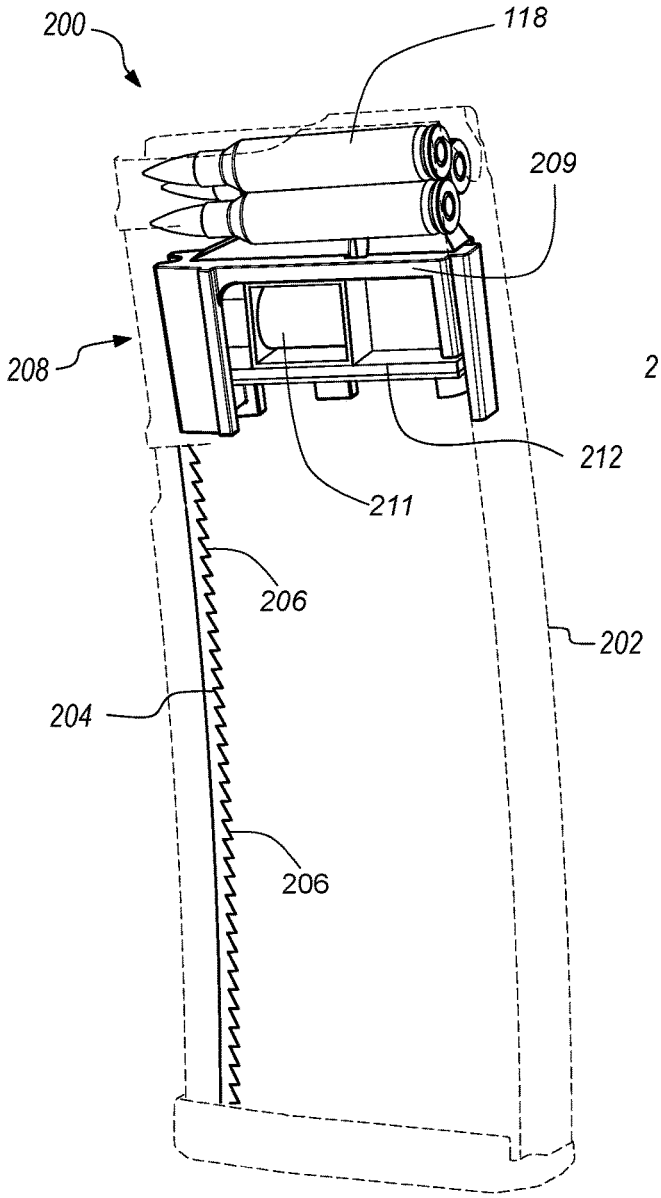
FIG. 4 illustrates a cutaway side view of a location-based gun magazine.
Figure 5:
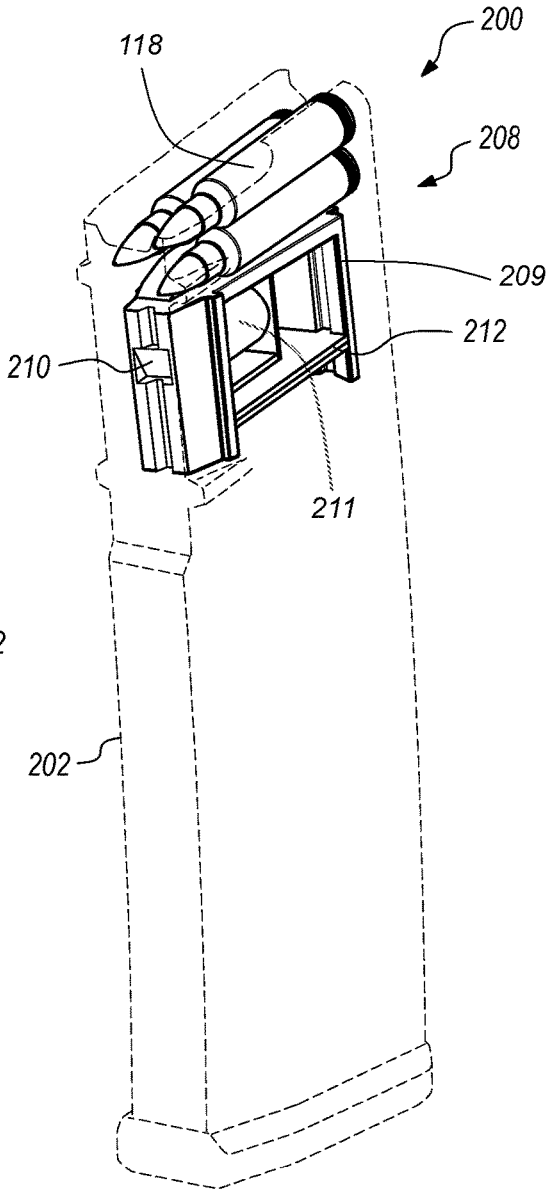
FIG. 5 illustrates a cutaway front perspective view of a location-based gun magazine.

Referring now to FIGS. 4-5, a location-based magazine 200 is shown that comprises a housing 202, a rack 204 comprising a plurality of teeth 206 along an inner wall of the housing 202, and a follower lock 208. The follower lock 208 comprises a linear actuator 211 for a locking tab 210. For example, the linear actuator 211 may be a screw-drive, an electromagnet, or other means. As shown, the follower lock 208 may comprise a circuit board 212, which may further comprise a microcontroller (or other controller/processor), a transceiver, and/or GPS receiver. As described in the earlier embodiments, the locking tab 210 may be controlled depending upon the physical location of the location-based magazine 200. In this embodiment, the locking tab 210 engages the rack 204, which prohibits movement of the bullets 118 in programmed locations. A typical spring (not shown) between the base of the magazine 200 and the follower 209 may be used to advance the follower 209 when the locking tab 210 is not engaged with the rack 204. Due to the arrangement of the teeth 206 on the rack 204 and the locking tab 210, the follower 209 may be depressed and bullets 118 inserted into the magazine regardless of location. However, the locking tab 110 prohibits the follower 209 from advancing. Accordingly, if the GPS receiver is within the known range, as determined by the microcontroller, the locking tab 210 is disengaged from the teeth 206, allowing the follower 209 to advance and eject bullets 118 from the magazine 200.

Figure 6:
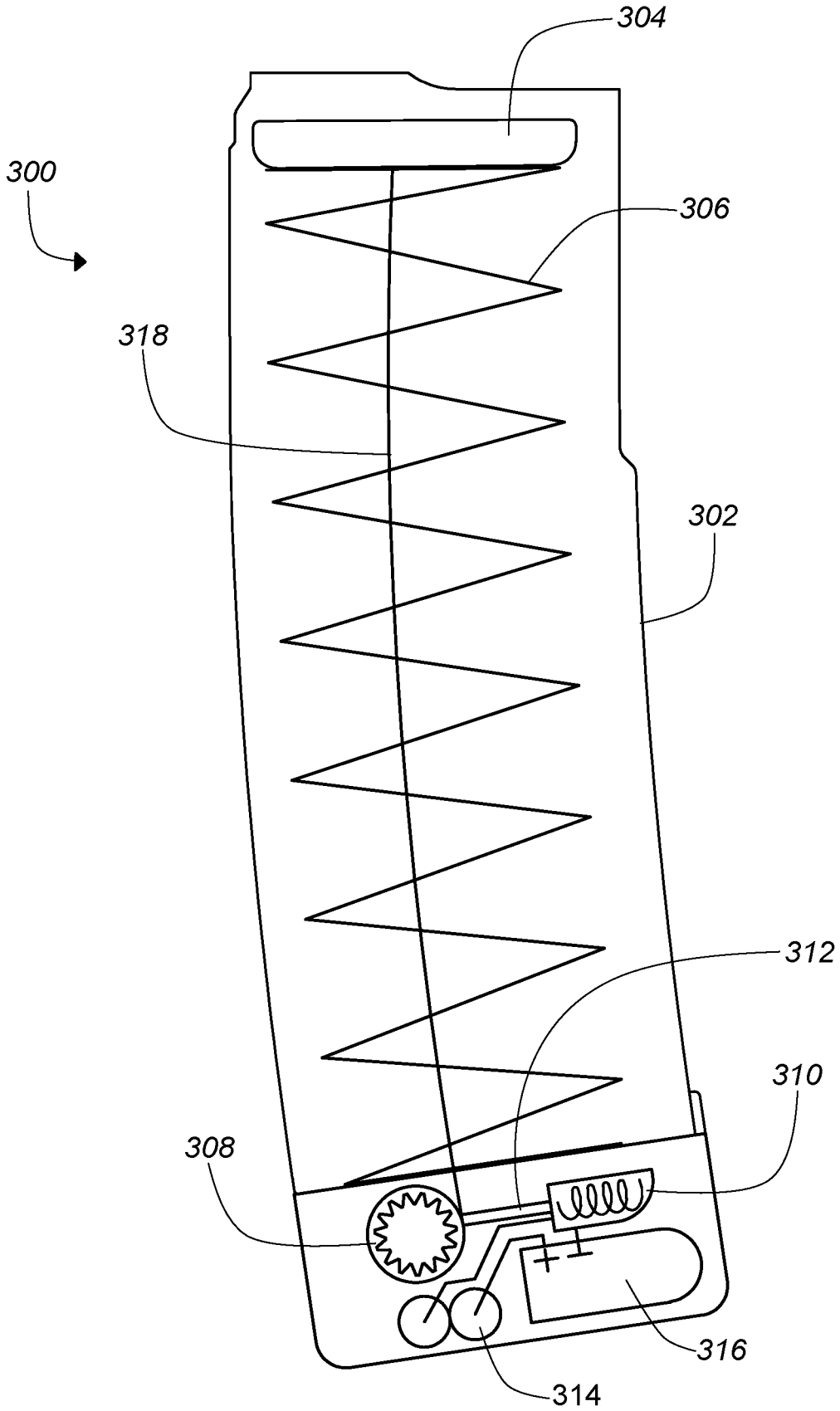
FIG. 6 illustrates a side cross-section of a location-based gun magazine.
Figure 7:
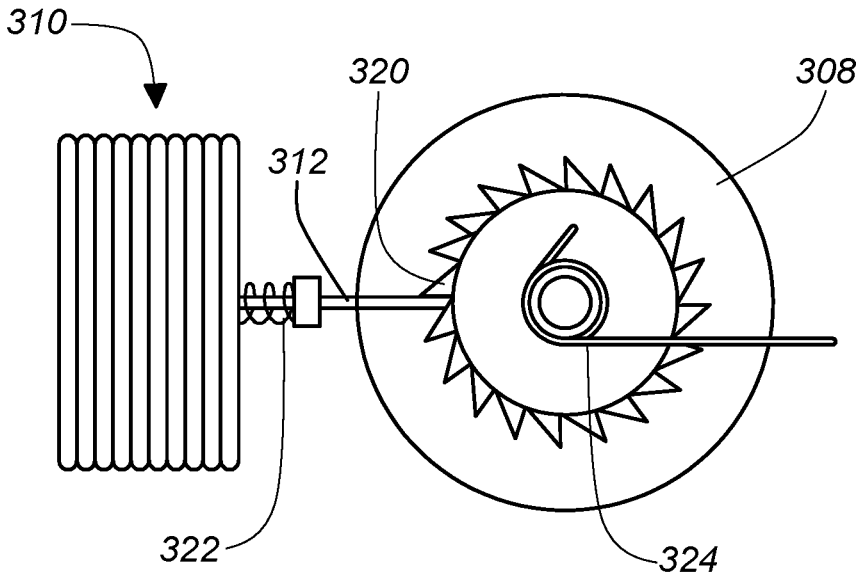
FIG. 7 illustrates a detailed side view of a follower lock of a location-based gun magazine.
Figure 8:
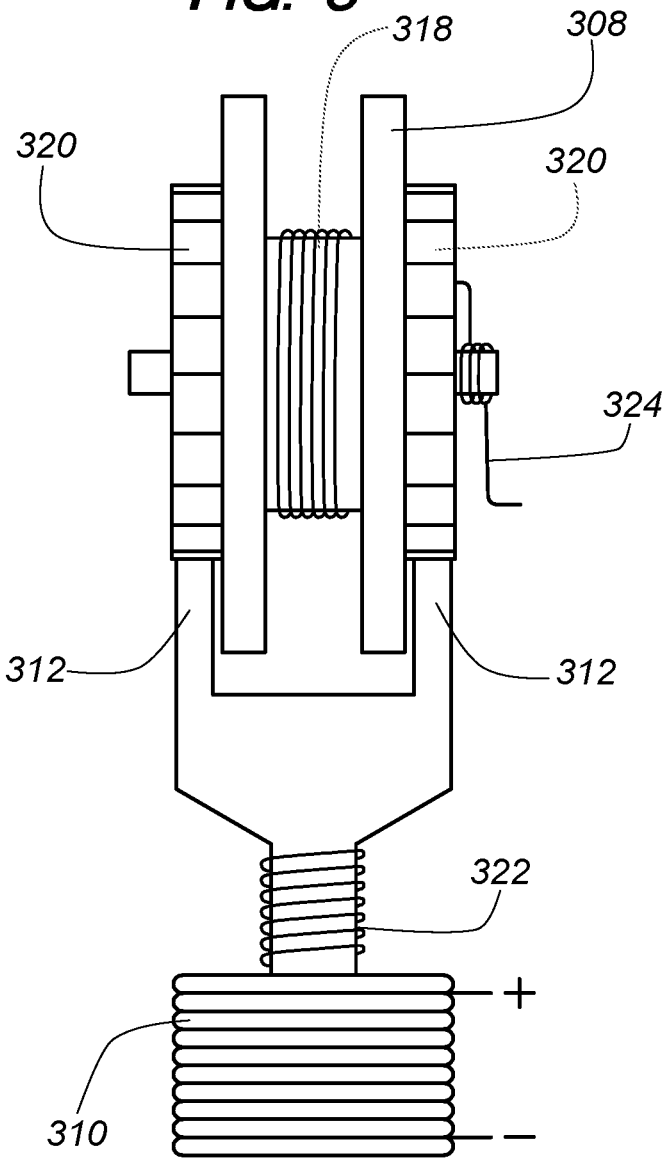
FIG. 8 illustrates a detailed top view of a follower lock of a location-based gun magazine.
Figure 9:
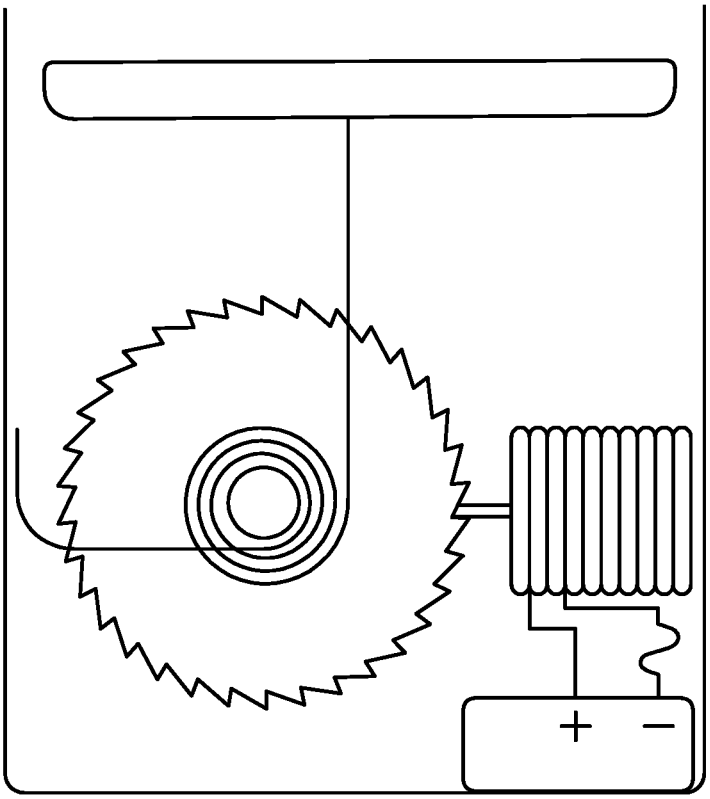
FIG. 9 illustrates a detailed side view of a follower lock of a location-based gun magazine.
Figure 10:
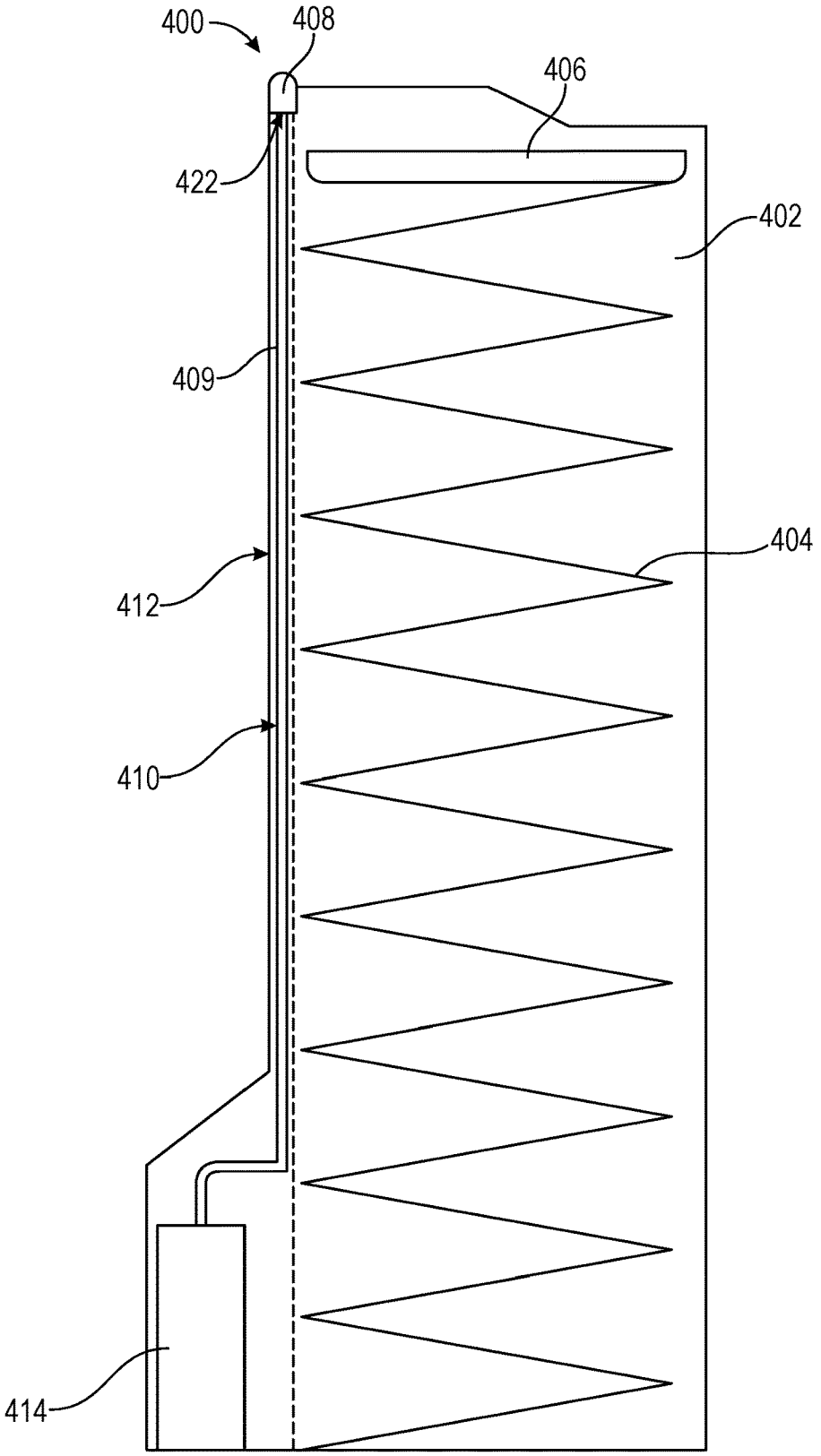
FIG. 10 illustrates a side cross-section of a location-based gun magazine.
Figure 11:
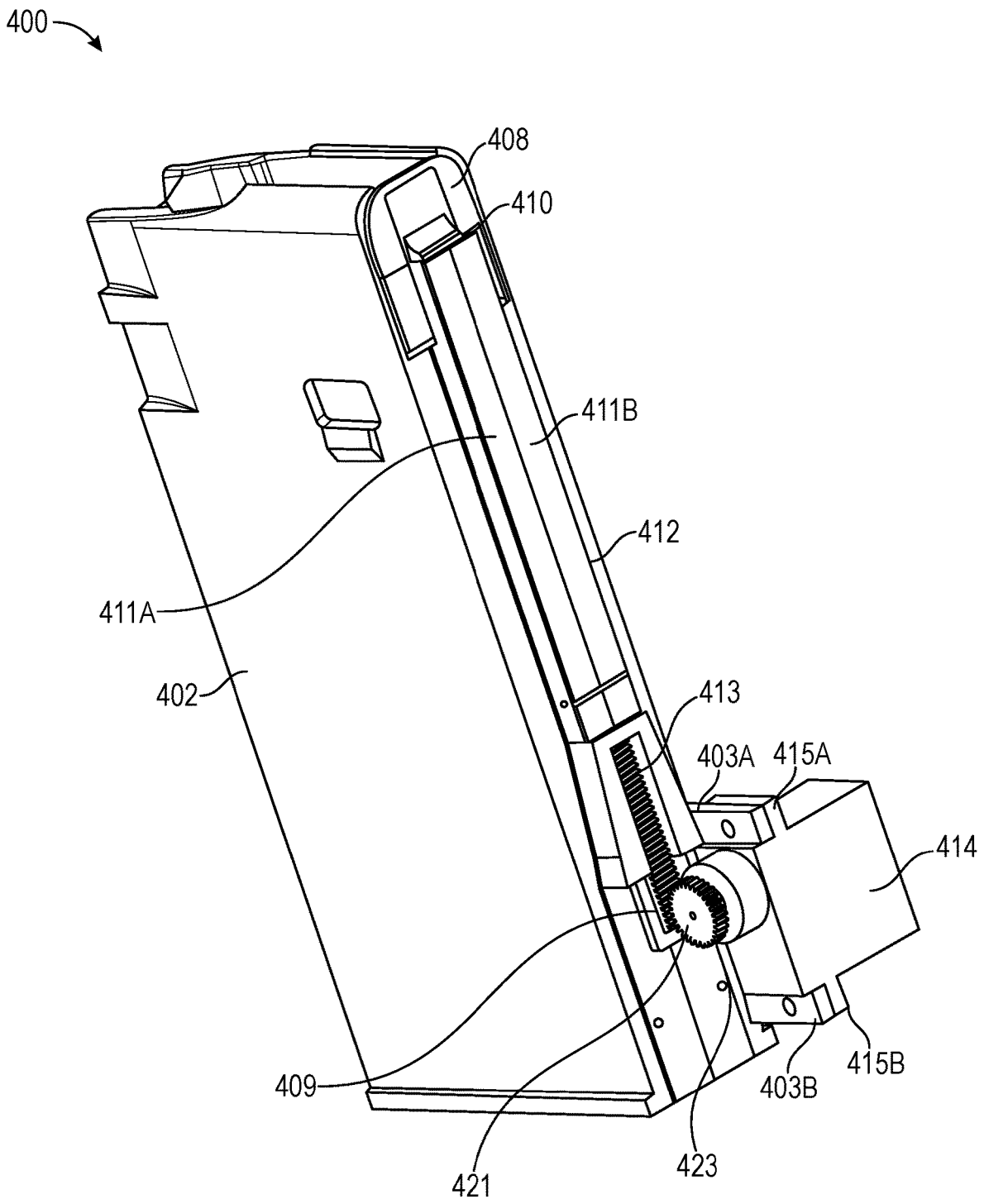
FIG. 11 illustrates a rear, right side perspective view of a location-based gun magazine.
Figure 12:
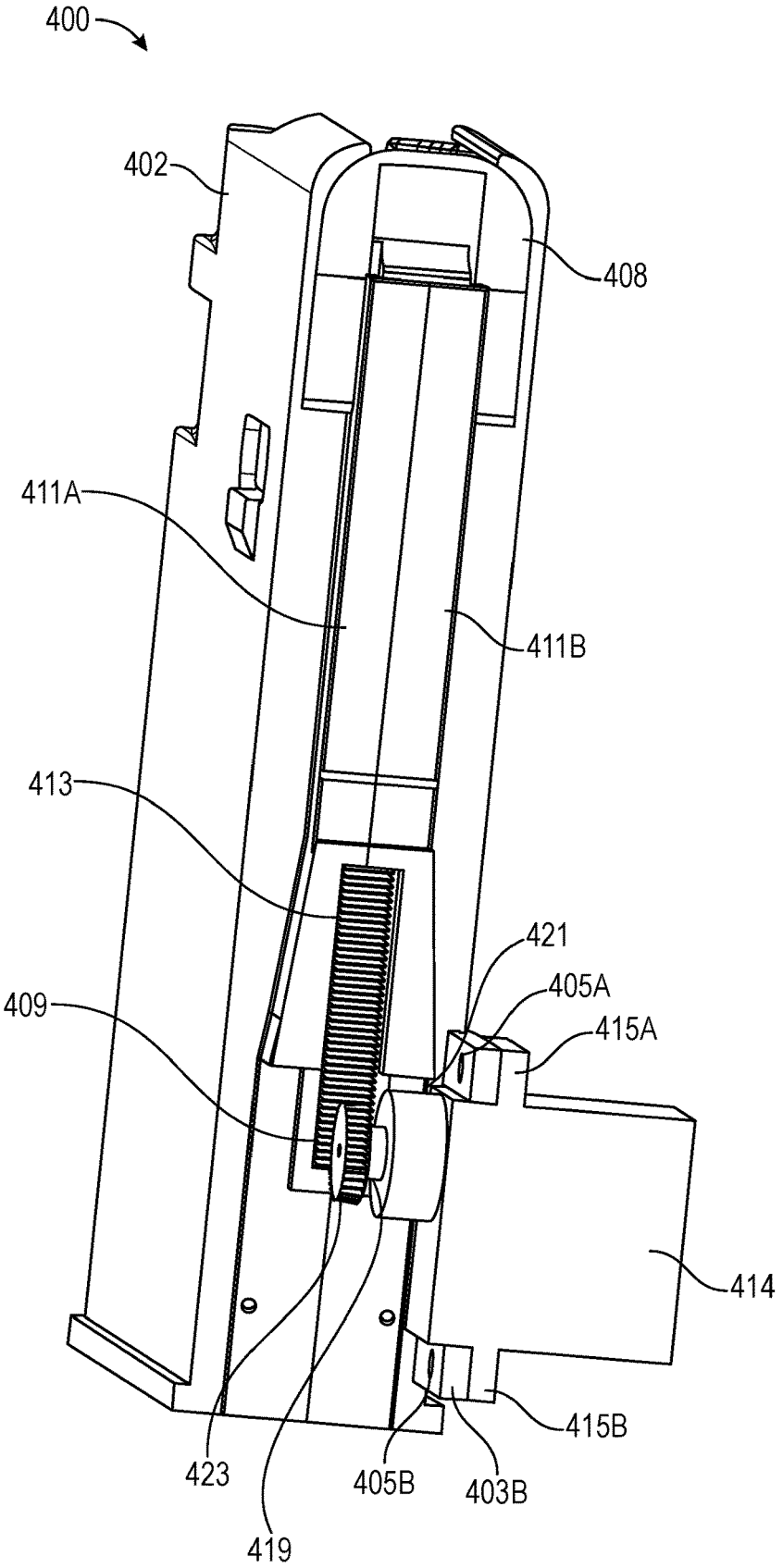
FIG. 12 illustrates a rear perspective view of a location-based gun magazine.
Figure 13:
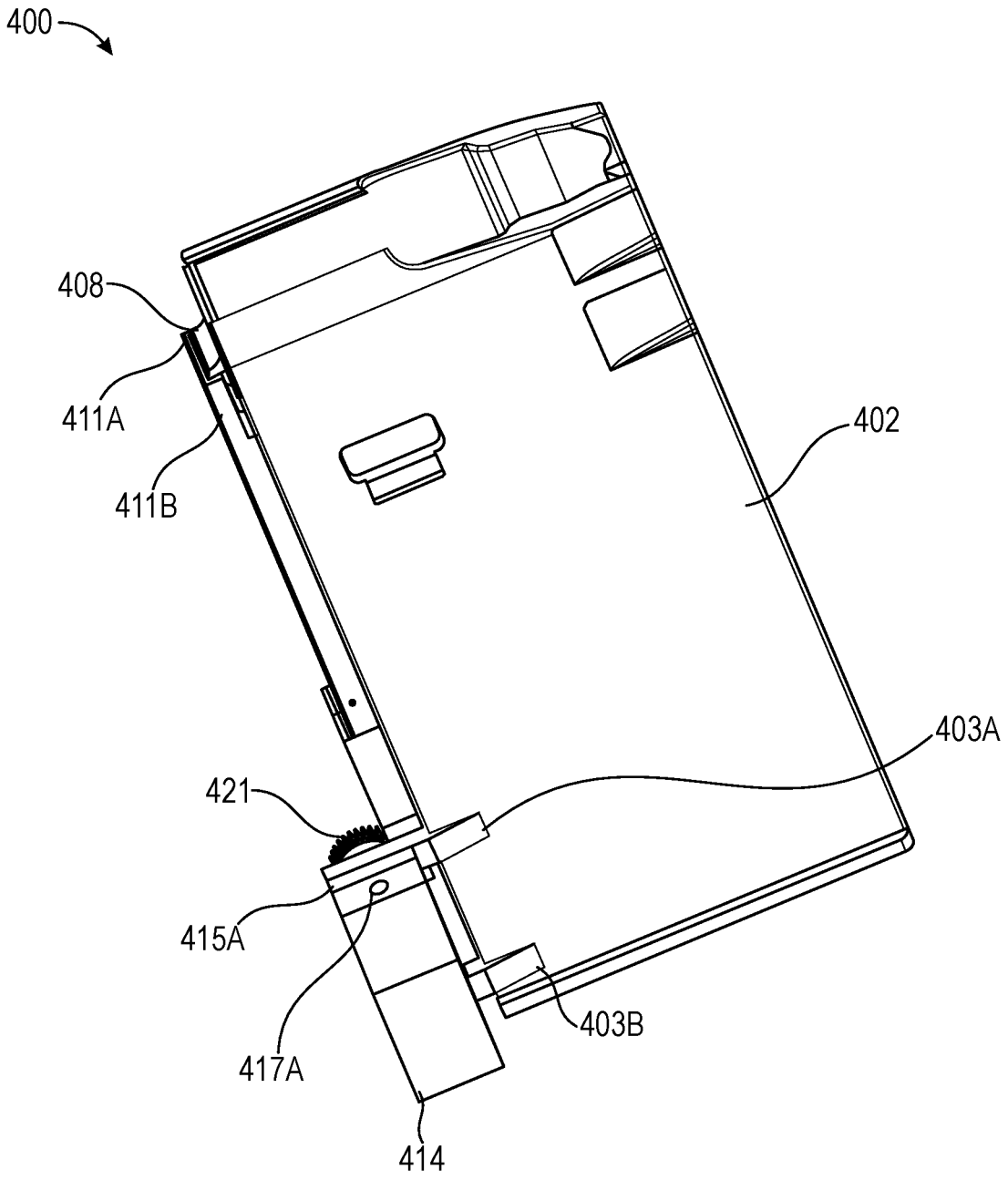
FIG. 13 illustrates a left side perspective view of a location-based gun magazine.
Figure 14:
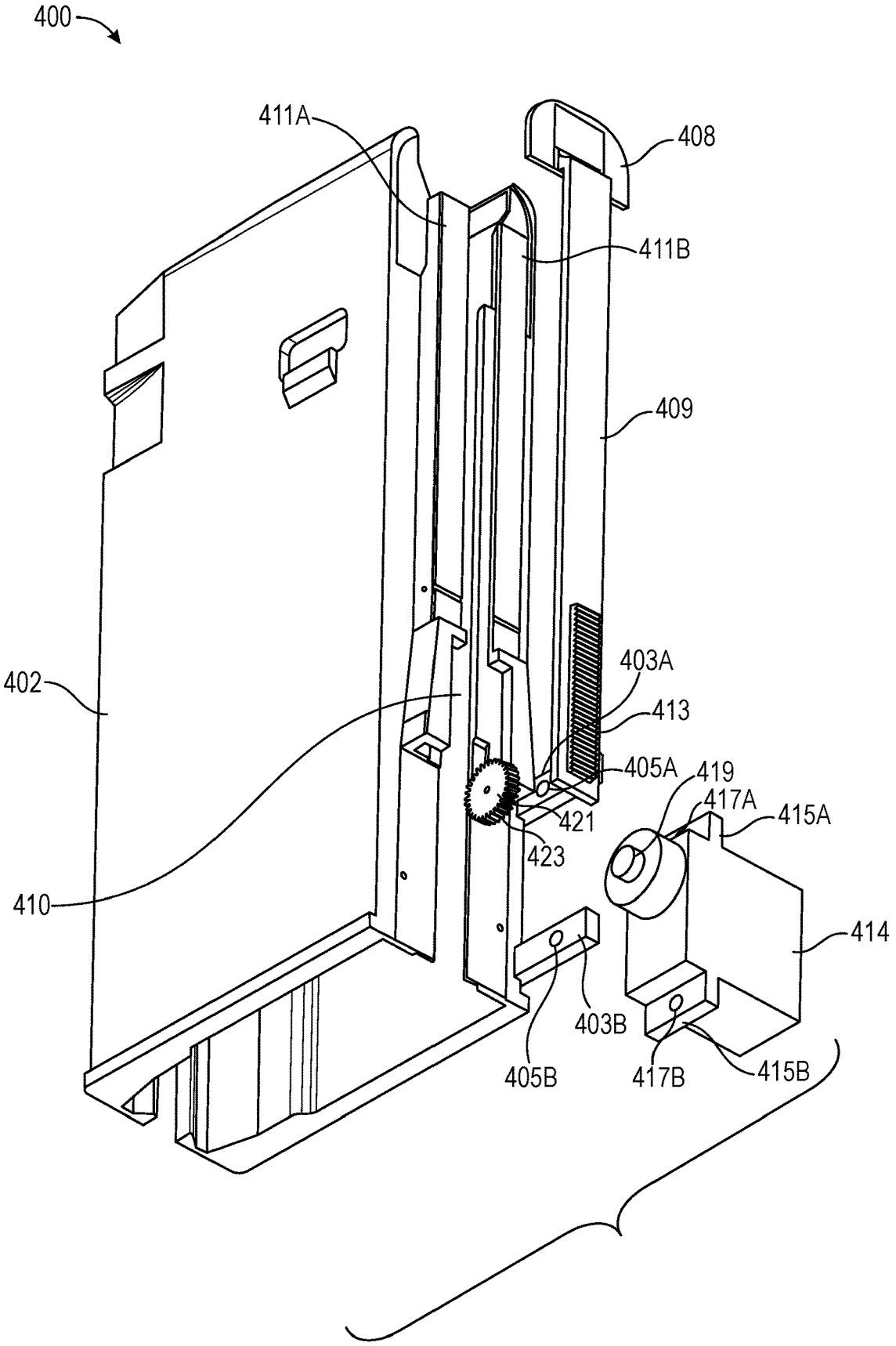
FIG. 14 illustrates an exploded view of a location-based gun magazine.

FIG. 6 illustrates a location-based magazine 300 comprising a housing 302, a follower 304, a spring 306 for advancing the follower 304, and a follower lock comprising a spool 308, a solenoid 310 with a rod 312 (together functioning as a linear actuator) for locking the spool 308, a radio/GPS receiver 314, and a battery 316. In one example of use, bullets are inserted into the magazine 300, forcing the follower 304 downward which compresses the spring 306. Spring 306 is what forces the follower 304 upward, advancing bullets as they are fired. Here, a cable 318 is coupled to the follower 304 and is wound around spool 308. In other words, as follower 304 is lowered into the magazine 300, the spool 308 winds the cable 318. As best seen in FIGS. 7-8, when the solenoid 310 is in a de-energized state, the rod 312 is extended, using spring 322, and engages one or more teeth 320 of the spool 308. As understood, the spool 308 may use a spring 324 so as to maintain the cable 318 wound thereon. As a result of the rod 312 engaging the spool 308, the cable 318 prohibits the follower 304 from advancing, which thereby prohibits the bullets from exiting the magazine 300.

When powered "on," the GPS receiver receives a signal, which is then processed by a microcontroller. If determined to be within a shooting area, the microcontroller energizes the solenoid, which causes the rod 312 to retract and disengage the spool 308. With the spool disengaged, the spring 306 may extend as bullets are fired, allowing the follower to advance unrestricted.

Referring to FIGS. 10-14, in one embodiment, a location-based gun magazine 400 comprises a housing 402 having a spring 404 which is coupled to a follower 406. The housing 402 may further comprise a first arm 403A with an aperture 405A and a second arm 403B with an aperture 405B. A blocking tab 408 may be positioned in a channel 410 surrounded by a first channel sidewall 411A and a second channel sidewall 411B so as to be moveable up and down in a linear movement. More specifically, the blocking tab 408 may be coupled to a shaft 409 that extends into the channel 410. The shaft 409 may further comprise a plurality of teeth 413. The blocking tab 408 and channel 410 may be positioned on a rear side 412 of the housing 402. While shown on the rear side, it will be appreciated that in some embodiments, the blocking tab 408 and channel 410 may be on a front side of the location-based gun magazine 400.

The blocking tab 408 is moveable in a linear direction via an actuator 414 (a motor or solenoid). The actuator 414 may comprise a first protrusion 415A with a first aperture 417A and a second protrusion 415B with a second aperture 417B. Additionally, the actuator 414 may comprise a drive shaft 419, which may receive a gear 421 having teeth 423 that interact with the plurality of teeth 413 on the shaft 409. The first protrusion 415A and second protrusion 415B may couple to the first arm 403A and second arm 403B of the housing 402. For example, once the first and second protrusion apertures 417A, 417B are aligned with the apertures 405A, 405B of the first and second arms 403A, 403B, then a fastener (e.g., a screw) may be inserted therethrough, coupling the actuator 414 to the housing 402.

In some embodiments, the magazine 400 may comprise a wireless receiver device and a battery, such as the wireless receiver device and battery shown in FIG. 3. In one embodiment, the wireless receiver device comprises a radio receiver. In one embodiment, the wireless receiver device comprises a GPS (Global Positioning System) receiver. Therefore, in one embodiment, the wireless receiver device receives information from a radio signal or receives information based upon its location (GPS). In one non-limiting example, the wireless receiver device uses GPS to determine its location. If the location is determined to be a shooting zone (e.g., shooting range), the wireless receiver device sends a signal to have the blocking tab 408 prevent cartridges from entering the gun's chamber.

Figure 15:
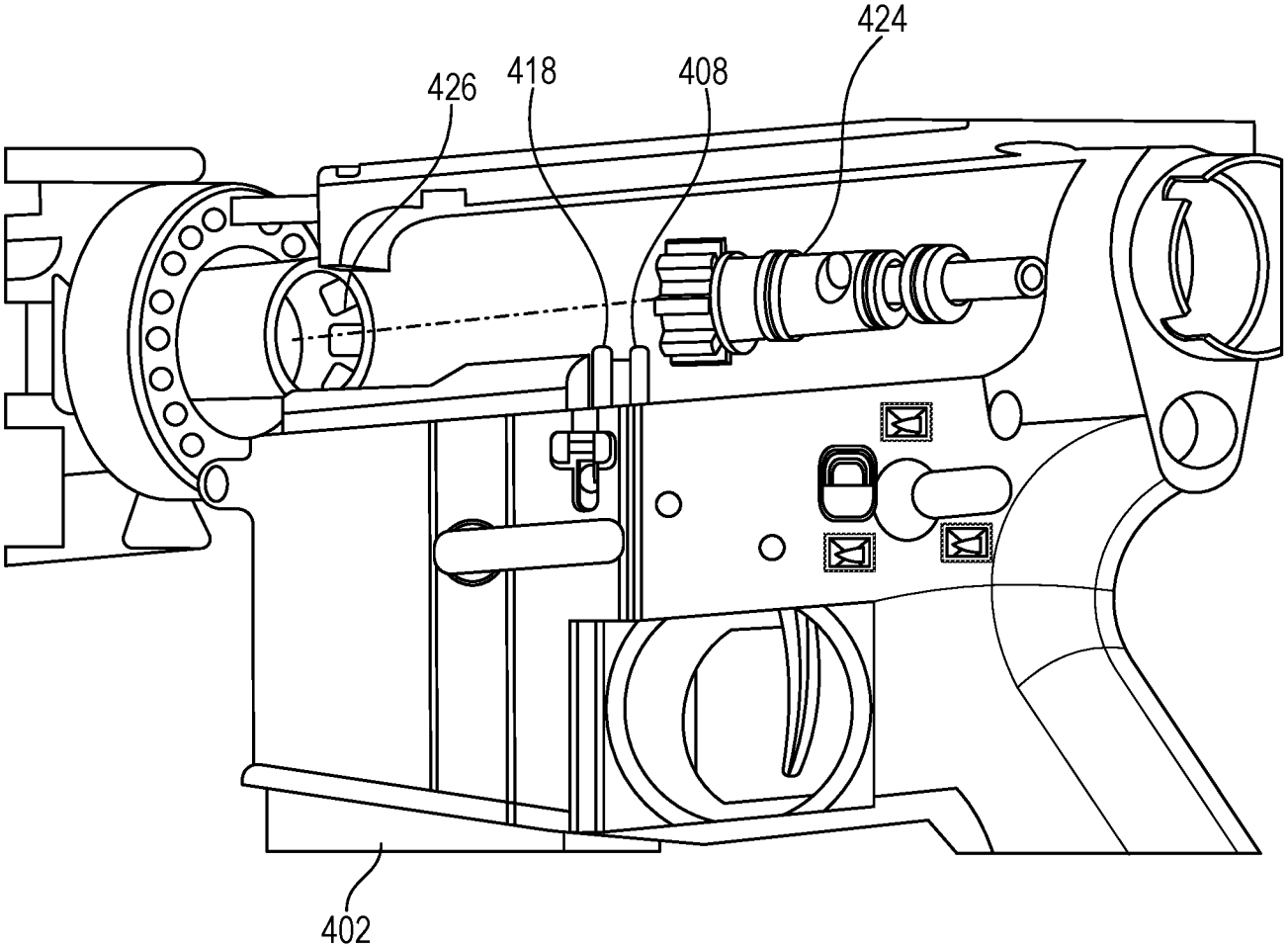
FIG. 15 illustrates a rear, side perspective view of a location-based gun magazine inserted into a gun.
Figure 16:
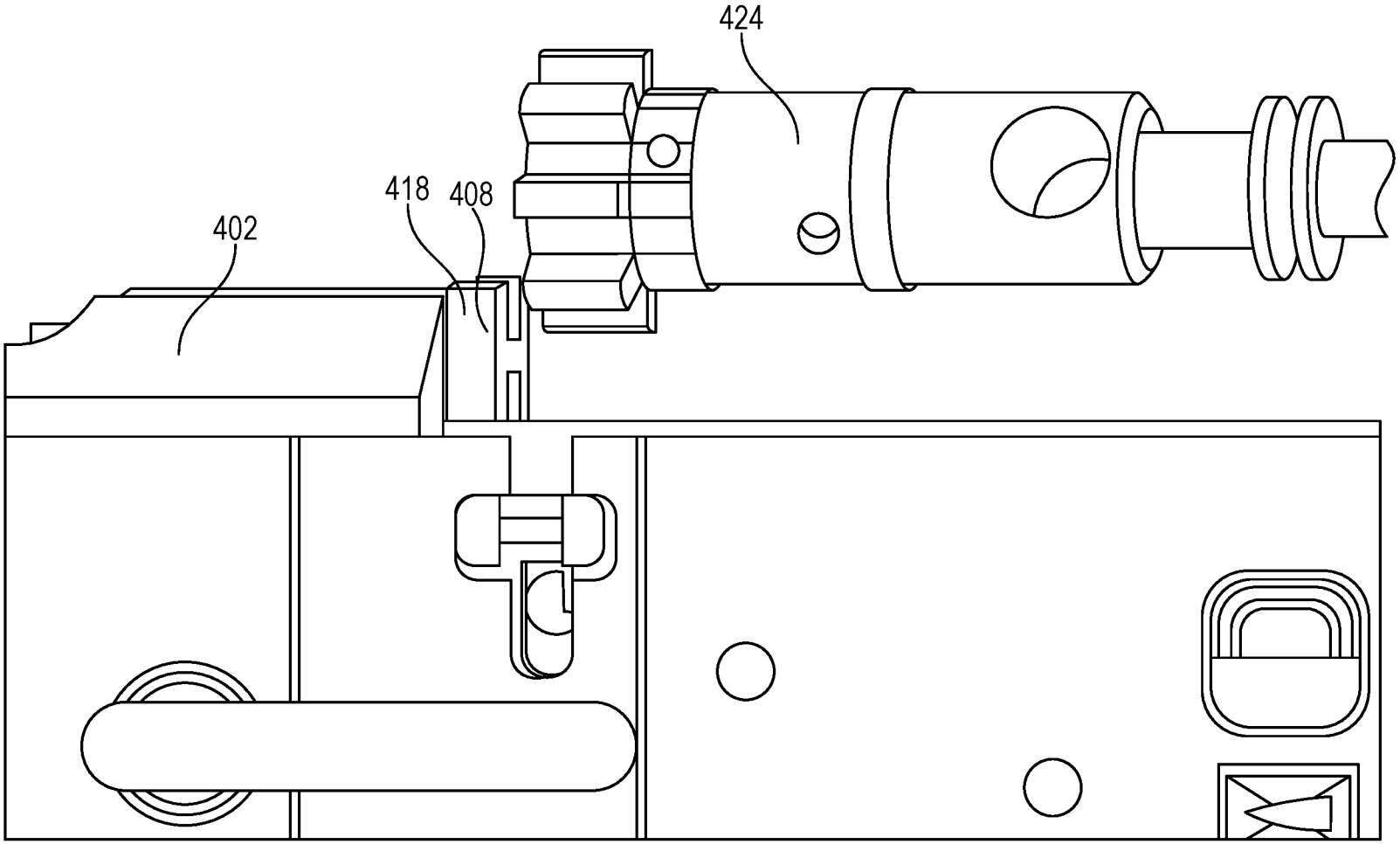
FIG. 16 illustrates a detailed side elevation view of a blocking tab of a location based-gun magazine in a first, extended position.
Figure 17:
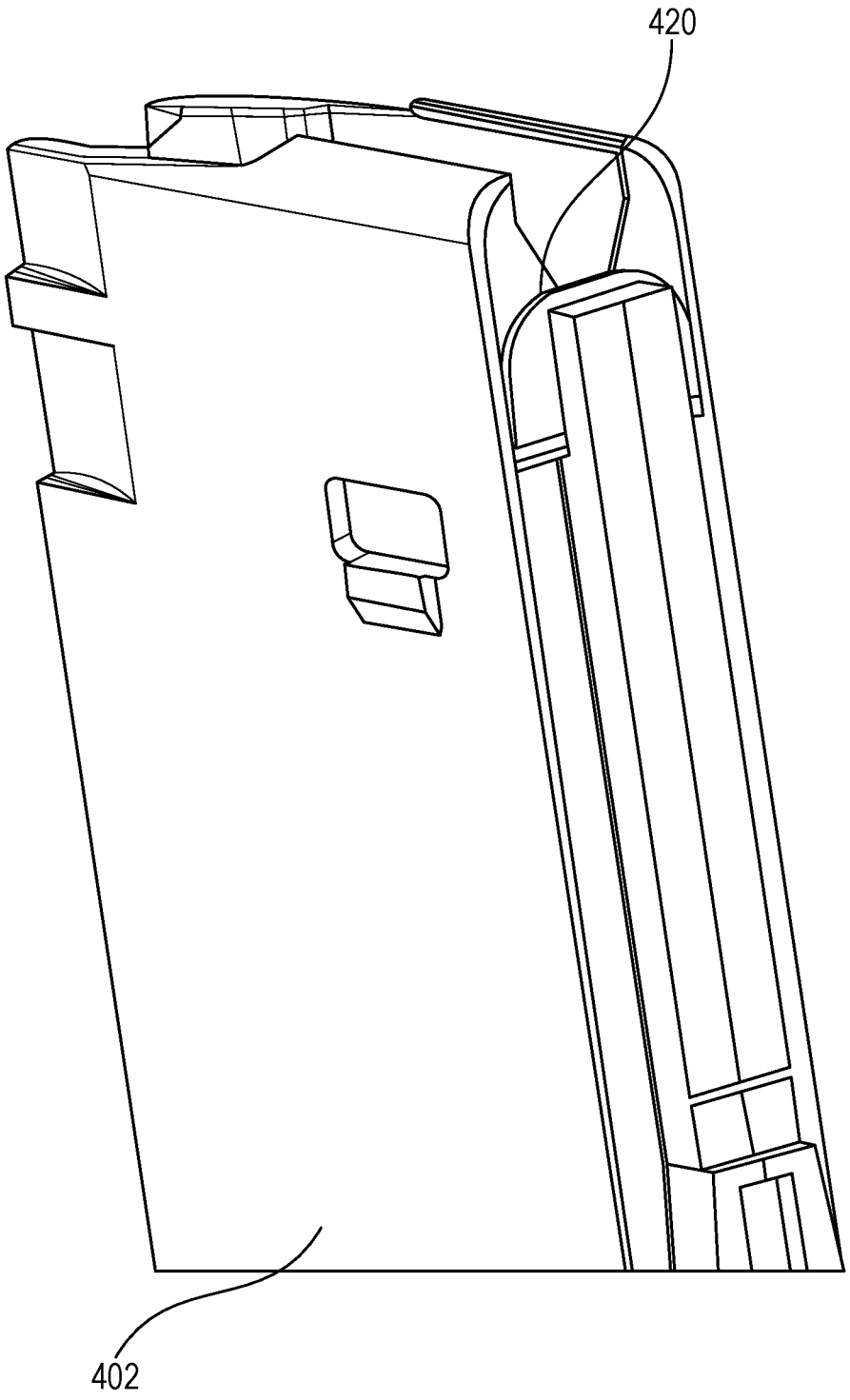
FIG. 17 illustrates a rear perspective view of a blocking tab in a second, retracted position.

As shown in FIGS. 15-17, when the blocking tab 408 is activated, the actuator 414, withdraws the blocking tab 408 from a first, extended position 418 (FIGS. 15-16) to a second, retracted position 420 (FIG. 17) through a tab aperture 422 (FIG. 10) into the channel 410 when the gear 421 interacts with the plurality of teeth 413 on the shaft 409. This allows the gun's bolt assembly 424 to continue in a forward motion, contacting, and inserting a cartridge into a chamber 426 of the gun (i.e., functions as a standard gun magazine). In the alternative, if the GPS receiver of the wireless receiver device is not in a safe zone (e.g., a school), the actuator 414 remains inactive and the blocking tab 408 remains extended or in the first position 418 through the tab aperture 422, preventing the advancement of a cartridge into the chamber 426 of the gun. In this manner, when the blocking tab 408 is in the first, extended position 418, cartridges may not exit the magazine 400.

In one embodiment, shooting zones (e.g., shooting ranges) may be programmed by the manufacturer or may be input by the owner. For example, an owner of a gun may program the magazine 400 so that the magazine 400 only functions at certain shooting ranges. In this way, the owner's gun may not be used, stolen, or otherwise used in an unauthorized manner for a mass-shooting. In other words, the magazine 400 will only function at a gun range, or other area as defined by the owner (or manufacturer).

Other scenarios are envisioned. For example, a homeowner may desire a gun for self-defense, but would not allow that gun to be fired at a school. The owner could program the magazine 400 to be usable at home (i.e., the blocking tab 408 would be in the second position 420) while not being usable outside of the owner's property (i.e., blocking tab 408 in the first position 418). Again, this prevents unauthorized use of the weapon for domestic terrorism, mass shootings, or other violence. Additionally, in one embodiment, typical magazines may be refitted to comprise the blocking tab 408 and actuator 414.

Figure 18:
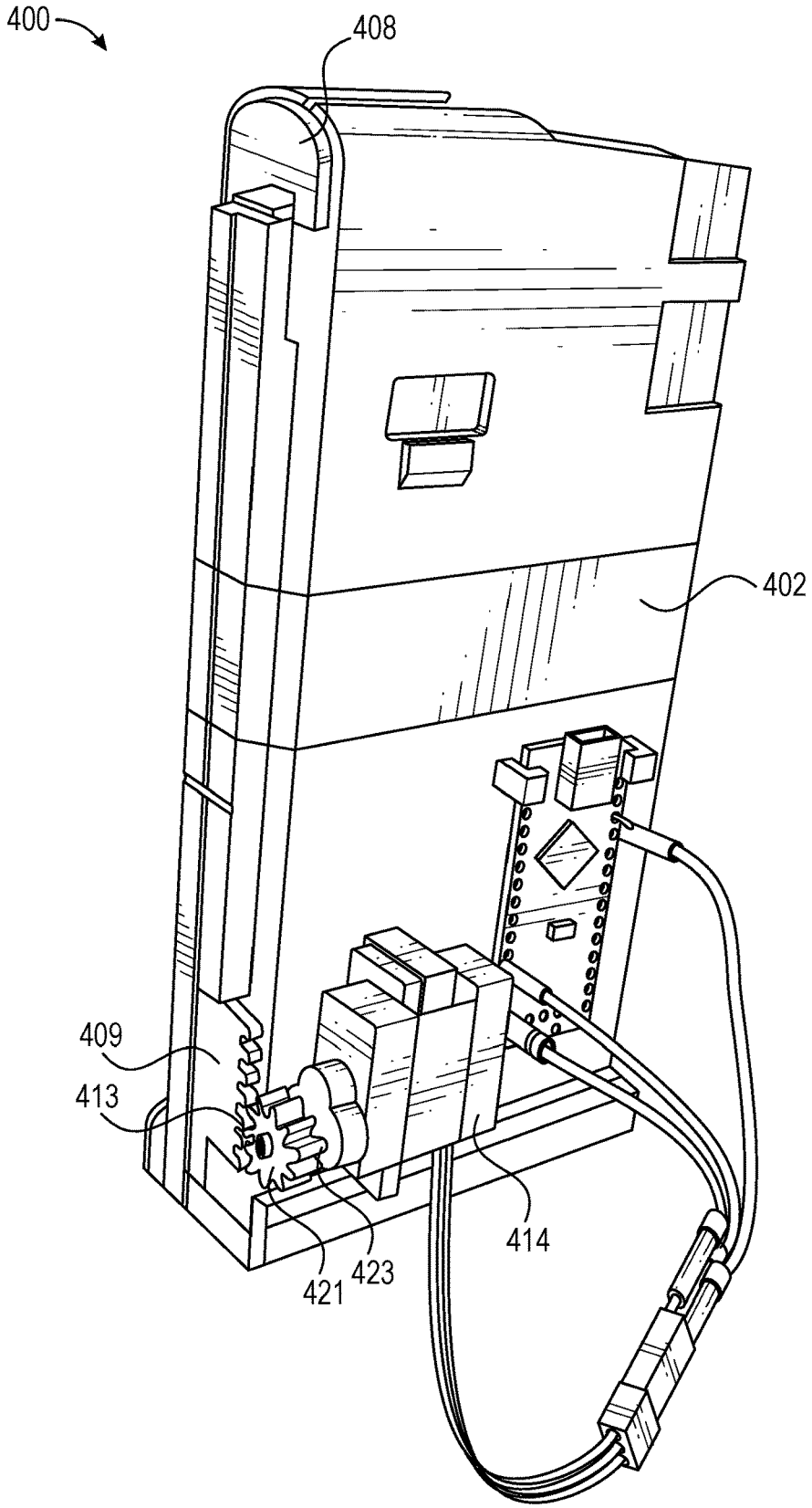
FIG. 18 illustrates a rear, side perspective view of a location based-gun magazine.

In one embodiment, as shown in FIG. 18, the shaft 409 may comprise a plurality of teeth 413 on a side of the shaft 409. Further, the actuator 414 may be positioned on a side of the housing 402 and the gear 421 with teeth 423 may interact with the plurality of teeth 413 on the side of the shaft 409. Accordingly, it will be appreciated that the actuator 414 may be on a rear of the housing 402, right or left sides, or any other location on the housing 402.

Figure 19:
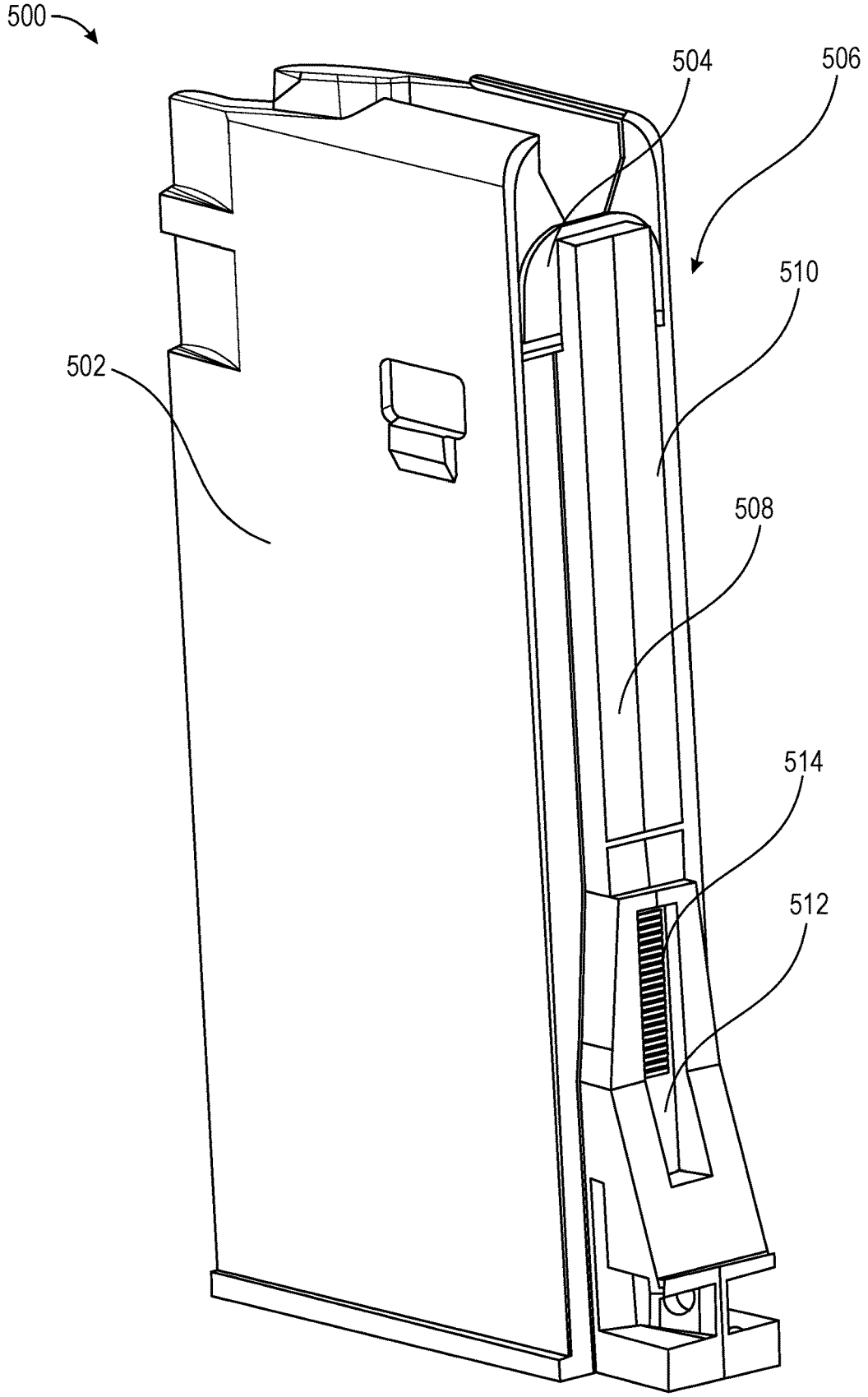
FIG. 19 illustrates a perspective view of a location-based gun magazine.
Figure 20:
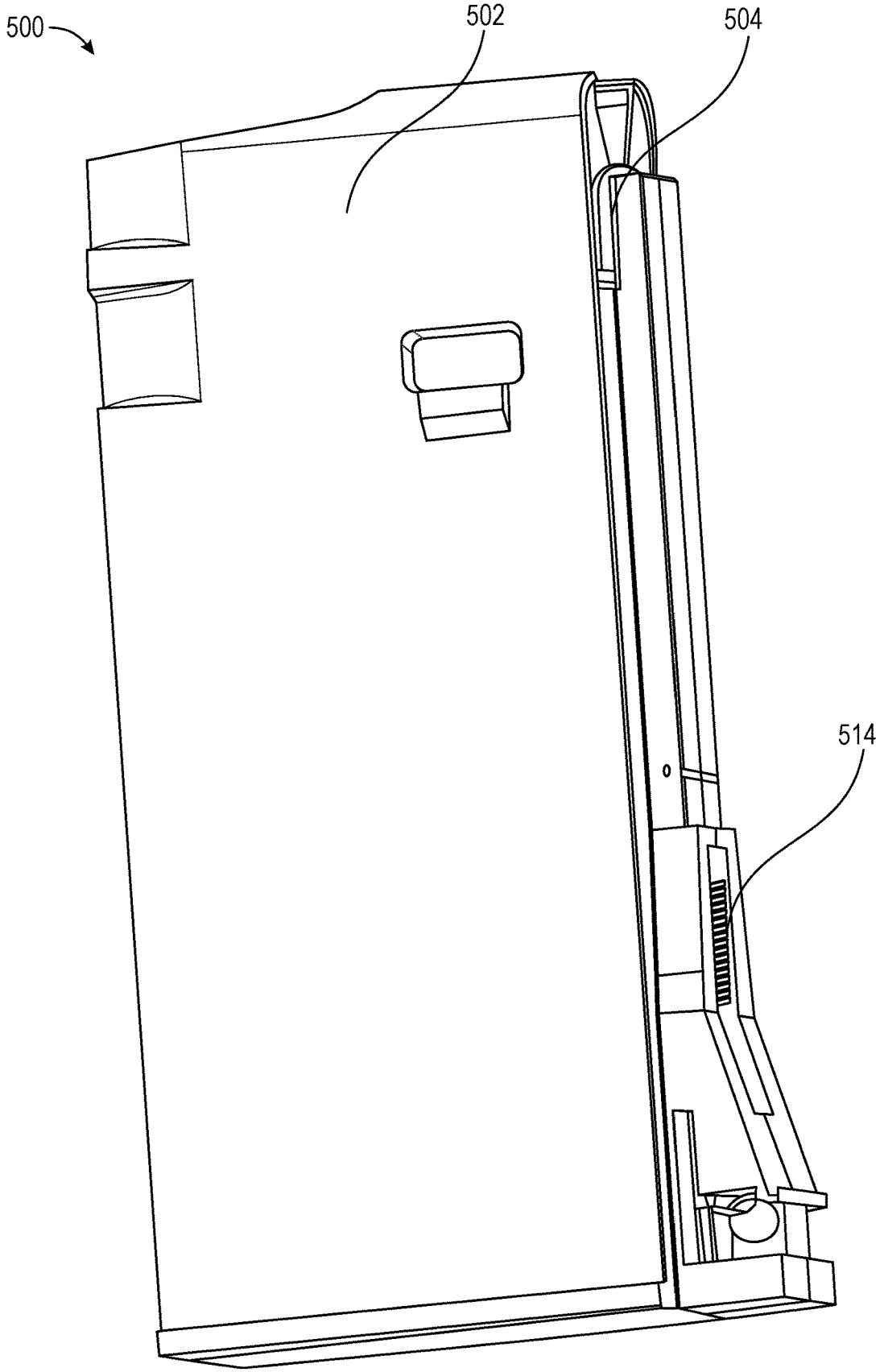
FIG. 20 illustrates a side perspective view of a location-based gun magazine.

In one embodiment, as shown in FIGS. 19-20, a gun magazine 500 comprises a housing 502 and a follower coupled to a spring. Further, a blocking tab 504, which may be positioned in a channel so as to be moveable up and down in a linear movement, may be positioned on a rear side 506 of the magazine 500. The channel may be created by a first sidewall 508 and a second sidewall 510. The blocking tab 504 may be coupled to a shaft 512 that extends into the channel. The shaft 512 may comprise a plurality of teeth 514. The blocking tab 504 may be mechanically moved from a first position, extended position to a second, retracted position and vice versa via pressure plates, buttons, or any other actuator. Accordingly, a user may push in the pressure plates and manually pull a slide down allowing the blocking tab 504 to be unlocked. When the pressure plates are pushed, the blocking tab 504 via the shaft 512 is moved back to the first position, thereby preventing more rounds from being fired. Further, the blocking tab 504, in some embodiments, is operated without the need of keys or other technology.

It will be appreciated that the magazine 400, 500 may help prevent mass shootings, incidental shootings, suicide, and any other improper use of firearms. It will further be appreciated that the blocking tab 408, 504 does not impact functionality of the weapon when unlocked.

Accordingly, a method of controlling bullets using a location-based magazine comprises determining the location of a gun magazine, and based upon location, prohibiting the bullets from ejecting from the magazine into the firearm.

It will be appreciated that while radio and GPS were used as examples herein, the present embodiments are not limited to such technology, and other means of determining location may be used. For example, one alternative could be RFID chips, with the chips receiving signals from transmitters at certain locations (e.g., gun ranges). Similar technologies may be used. Further, while an electromagnet is disclosed, other methods of achieving the same result may likewise be employed. In other words, the locking tab 114 may be withdrawn from the locking aperture using any number of methods (e.g., linear actuators), which may not require an electromagnet. Such changes fall within the scope of this disclosure.

It will also be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A location-based gun magazine comprising:

a housing that receives cartridges, the housing comprising a follower coupled to a spring;

a blocking tab that prevents cartridges from exiting the location-based gun magazine, the blocking tab coupled to a shaft with a plurality of teeth, the shaft extending downward into a channel;

an actuator that couples to the housing and controls movement of the blocking tab, the actuator comprising a gear that interacts with the plurality of teeth on the shaft to move the blocking tab from a first position to a second position.

2. The location-based gun magazine of claim 1, wherein the housing further comprises a first arm and a second arm.

3. The location-based gun magazine of claim 2, wherein the actuator further comprises a first protrusion that couples to the first arm.

4. The location-based gun magazine of claim 2, wherein the actuator further comprises a second protrusion that couples to the second arm.

5. The location-based gun magazine of claim 1, wherein the housing further comprises a first channel sidewall and a second channel sidewall surrounding the channel.

6. The location-based gun magazine of claim 1, wherein the actuator further comprises a drive shaft coupled to the gear.

7. The location-based gun magazine of claim 1, wherein the first position is a vertically extended position that prevents a cartridge from entering a chamber of a gun.

8. The location-based gun magazine of claim 1, wherein the second position is a retracted position that allows a cartridge to enter a chamber of a gun.

9. The location-based gun magazine of claim 1, wherein the blocking tab is positioned on a rear side of the housing.

10. The location-based gun magazine of claim 1, wherein the actuator comprises a motor to move the blocking tab.

11. The location-based gun magazine of claim 1, wherein the actuator comprises a solenoid to move the blocking tab.

12. The location-based gun magazine of claim 1, wherein when the actuator is activated, the blocking tab retracts through a tab aperture into the channel from the first position to the second position.

13. A location-based gun magazine comprising:

a housing to receive cartridges, the housing comprising:

a follower coupled to a spring, a first arm with a first aperture, and a second arm with a second aperture;

a first channel sidewall and a second channel sidewall forming a channel;

a blocking tab that prevents cartridges from exiting the location-based gun magazine, the blocking tab coupled to a shaft with a plurality of teeth, the shaft extending downward into the channel;

an actuator that controls movement of the blocking tab, the actuator comprising:

a first protrusion with a first aperture, the first protrusion coupleable to the first arm;

a second protrusion with a second aperture, the second protrusion coupleable to the second arm; and a drive shaft coupled to a gear that interacts with the plurality of teeth on the shaft to move the blocking tab.

14. The location-based gun magazine of claim 13, further comprising a microcontroller that determines, via GPS signals, when the location-based gun magazine is located within a predetermined location to activate the actuator, which retracts the blocking tab.

15. The location-based gun magazine of claim 13, wherein when the actuator is activated, the blocking tab retracts through a tab aperture into the channel from a first, extended position to a second, retracted position.

16. The location-based gun magazine of claim 15, wherein the first position is a vertically extended position that prevents a cartridge from entering a chamber of a gun.

17. The location-based gun magazine of claim 15, wherein the second position is retracted position that allows a cartridge to enter a chamber of a gun.

18. The location-based gun magazine of claim 13, wherein the actuator comprises a motor to move the blocking tab.

19. The location-based gun magazine of claim 13, wherein the actuator comprises a solenoid to move the blocking tab.

* * * * *